United States Patent [19]

Achelpohl et al.

[11] 4,371,367

[45] Feb. 1, 1983

[54] APPARATUS FOR PULLING OPEN TUBE SECTIONS TO FORM BASE SQUARES IN THE PRODUCTION OF CROSS-BOTTOM SACKS

[75] Inventors: Fritz Achelpohl, Lengerich; Werner Decker, Ladbergen, both of Fed. Rep. of Germany

[73] Assignee: Windmoller & Holscher, Lengerich, Fed. Rep. of Germany

[21] Appl. No.: 171,803

[22] Filed: Jul. 24, 1980

[30] Foreign Application Priority Data

Aug. 3, 1979 [DE] Fed. Rep. of Germany ..... 2931607

[51] Int. Cl.[3] ..... B31B 1/52; B31B 1/80

[52] U.S. Cl. ..... 493/256; 493/259

[58] Field of Search ..... 493/256, 255, 257–259, 493/308; 53/378, 386, 384

[56] References Cited

U.S. PATENT DOCUMENTS

| | | | |
|---|---|---|---|
| 1,165,765 | 12/1915 | Duvall | 493/256 |
| 2,224,656 | 12/1940 | Robinson | 493/256 X |
| 3,250,187 | 5/1966 | Kasting | 493/256 X |
| 3,547,010 | 12/1970 | Gennerich et al. | 493/256 X |

FOREIGN PATENT DOCUMENTS

| | | | |
|---|---|---|---|
| 1358710 | 3/1964 | France | 493/259 |

*Primary Examiner*—James F. Coan

*Attorney, Agent, or Firm*—Fleit & Jacobson

[57] ABSTRACT

An apparatus for opening and folding the end of a flattened tubular sheet to define the rectangular base of a bag or sack to be made from the sheet comprises a table having a slot through which the flattened sheet projects, the projection being formed into a bag base by suckers locating the projection in a pre-opened condition and grippers which engage opposed margins of the projection, one of the grippers being fixed and the other being secured to a pivotable arm.

17 Claims, 4 Drawing Figures

APPARATUS FOR PULLING OPEN TUBE SECTIONS TO FORM BASE SQUARES IN THE PRODUCTION OF CROSS-BOTTOM SACKS

The invention relates to an apparatus for pulling open tube sections to form base squares in the production of cross-bottom sacks, comprising suckers at both sides of the tube section which open one end of the tube section.

Cross-bottom sacks are made from tube sections in that they are pulled open at one or both ends while forming so-called base squares with opposed corner folds. To close the bases, so-called side folds are divided off at right-angles to the corner folds and turned inwardly towards the centre to overlap and they are connected to each other and to the corner folds by adhesive or weld seams. Before the bases are closed by turning the side folds inwardly, so-called internal locks may be placed on the open base squares and connected by adhesive or weld seams to the inner edges of the corner folds and to the outer edges of the inner wall of the tube disposed therebetween so as to obtain particularly well sealed bases. To reinforce the base, base cover sheets may be adhered to the bases closed by turning the side folds inwardly.

Numerous apparatuses and methods have already been disclosed for pulling the ends of tube sections open to form cross-bottoms but these are only suitable for making small sacks or do not permit the formation of base squares having precisely folded base corner folds.

It is therefore the problem of the present invention to provide an apparatus of the aforementioned kind with which the base square can be formed precisely and in particular it is possible to pull open the ends of tube sections intended for the production of large sacks.

According to the invention, this problem is solved in that a table plate for guiding and holding the tube section is provided with a central slot, the tube section projecting beyond the table plate by the length necessary for forming the base, that the suckers which locate the margins of one tube section end in a pre-opened position are disposed at one side of the table, and that grippers engaging opposed margins of the tube section at its mouth are provided centrally between the folded edges of the tube section, one of the grippers being secured to the frame and the other to an arm or structure which is pivoted to the frame and provided with a drive for swinging it through about 180° between the opposed sides of the table plate. After the tube section ends have been opened by the suckers to a small extent and the margins of the opening have been located in a predetermined position, the grippers engage the tube section at its opposed margins and pull it open in that the one gripper is swung to the opposite half of the table plate. The base square formed by thus pulling open the tube section end will then be flat and taut on the table plate.

Sharp and accurately disposed folded edges of the corner folds formed when pulling the bases open are achieved according to a further development of the invention in that spreaders at both sides of the grippers in the frame and on the pivotable arm have outer edges which pull out the folded edges of the corner folds of the base square and, in the spread condition, include an angle of 90°.

To permit the spreaders to be moved out of the base squares again after the tube sections have been pulled open, the spreaders are desirably pivotable to a contracted position about shafts normal to the plane expanded by their edges and about a shaft parallel to the gap in the table plate.

In a further development of the invention, the spreader shafts are mounted in a structure pivotable on the gripper shaft, a bevel gear secured on each spreader shaft engages a respective bevel gear on the gripper shaft, the gripper is freely rotatable on the gripper shaft and connected thereto by a torsion spring, and the gripper shaft is oscillatable by way of a lever having one end pivoted to a hinged pneumatic piston-cylinder unit. By means of this construction one ensures in a simple manner that, by means of the pneumatic piston-cylinder unit, the gripper and contracted spreaders are first swung inwardly and only swung to their displaced position by the bevel gear drive as the clamping pressure of the grippers increases. During inward swinging of the grippers with the spreaders, therefore, the gripper is overcome against the force of the torsion spring in such a way that, after swinging in of the spreaders, the oppositely directed spreader movements of the spreaders are derived from the further rotation of the gripper shaft.

Since during commencement of the swinging in motion the gripper is taken along by the gripper shaft by way of the torsion spring, one end of the torsion spring is desirably secured to the gripper shaft by way of a clamping ring to enable the grippers and spreaders to be aligned with one another.

Preferably, there is also an abutment on the gripper shaft that co-operates with a counter-abutment on the gripper and determines its limiting position.

In a further development of the invention, the spreaders are secured to pins which are longitudinally displaceable in the supports thereof and are held in their limiting positions by compression springs. The springs ensure that the spreaders which determine the folded edges of the corner folds will be held under tension.

Desirably, a pneumatic piston-cylinder unit is provided which, during pivoting of the arm, pushes the pins which are interconnected by a yoke towards the gap in the table. This construction avoids the need for pulling the folded edges of the corner folds formed during pivoting of the arm over the end edges of the spreaders, which would be difficult because of the friction and could result in disruption. Only when the pivoted arm has been swung to its limiting position and the base has been pulled open fully will the piston-cylinder unit release the pins carrying the spreaders so that the springs acting on the pins can pull the folded edges of the corner folds taut.

Desirably, the grippers and spreaders and the drives therefor are disposed in a frame which is longitudinally displaceable in the machine frame or in the pivot arm and is provided with a pneumatic piston-cylinder unit for pulling the opened base square taut. Instead of the piston-cylinder unit, the frame can be pulled taut by springs. These may be tension springs pulling on cables which are passed over direction-changing rollers and are secured at both sides of the frame.

In a further embodiment of the invention, grippers secured to endless chains at both sides of the outer edges of the table plate clamp the pulled-open base squares in front of the ends of the spreaders, the upper pivotable gripper jaws of the grippers being disposed in or under the table plane in the open condition and the grippers transporting the sack workpieces to the next processing station after pivoting away of the spreaders and the grippers engaging centrally therebetween.

The table plate is preferably inclined to the horizontal so that belts for transporting the sack rest on associated supporting rollers at a slight inclination and do not sag downwardly, which would be almost impossible to avoid with a purely vertical load. The oblique arrangement of the table plate also facilitates a better view of the entire installation.

Desirably, suckers are provided on each side of the spreaders which slightly pre-open the tube section which is to be formed with a base square so that the grippers can engage the margins of the opening.

One example of the invention will now be described in more detail with reference to the drawing, wherein.

Figure 1:
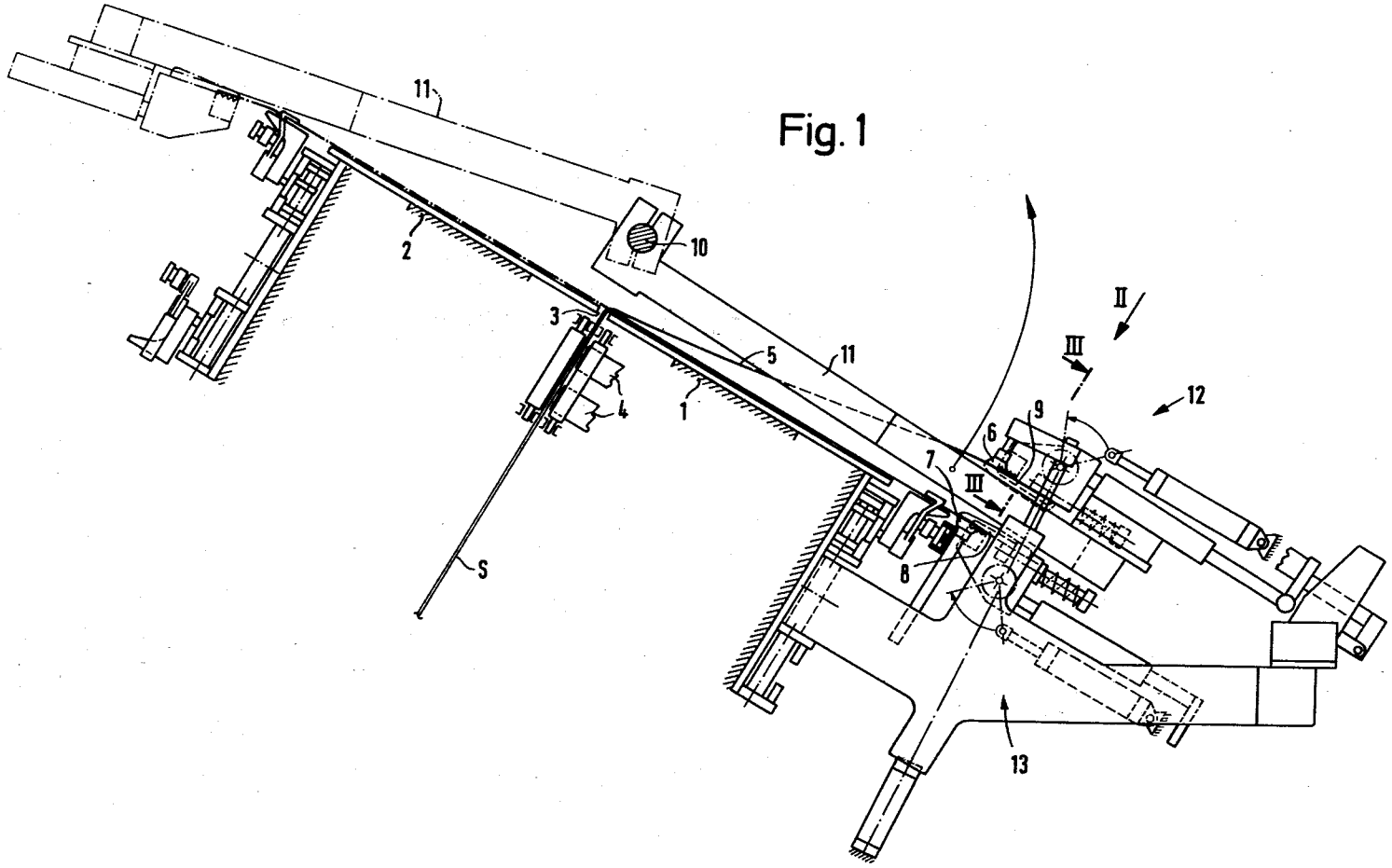
FIG. 1 is a diagrammatic section through the apparatus for pulling open tube sections.

The apparatus for pulling out the ends of tube sections S to form base squares consists of the fixed table plates 1, 2 which are inclined to the horizontal and between which a central gap 3 is provided. The tube sections S are advanced through this central gap 3 perpendicular to the plane of the drawing by conveyor belts 4 in such a way that they project therebeyond by a length necessary for forming the base. The ends 5 of the tube sections S to be pulled open are folded over the edge of the table plate 1 that bounds the gap 3. As soon as the tube section S has been conveyed into the pulling-open apparatus in the illustrated manner, pairs of suckers 6, 7 engage the margins of the tube section S and pull these apart. Between each part of suckers 6, 7, a gripper 8 is secured to the frame 14 and engages the lower margin of the opening and a gripper 9 secured to the bracket 11 which is pivotable about the fixed shaft 10 engages the upper margin of the opening of the tube section S.

Figure 2:
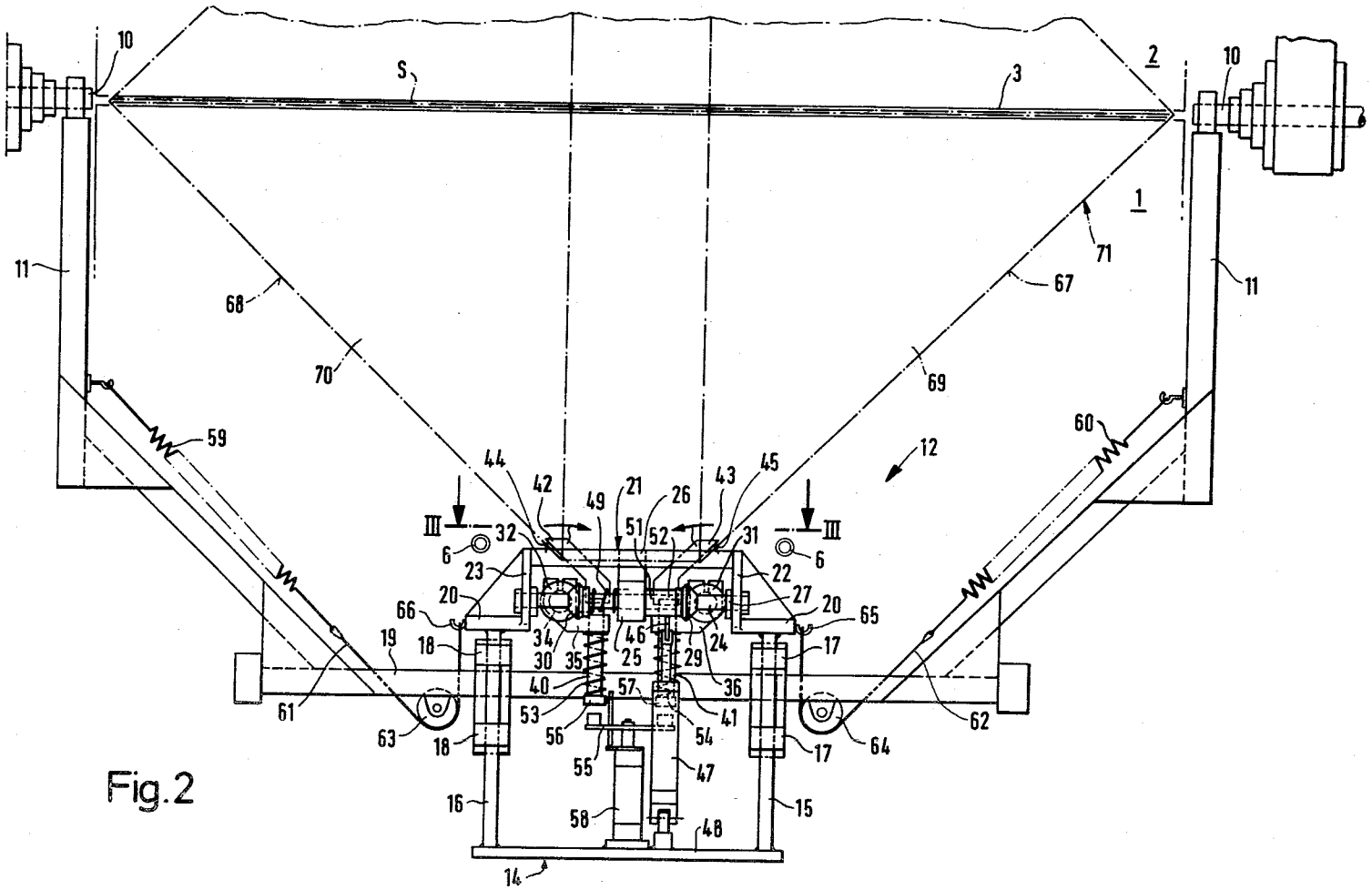
FIG. 2 is a plan view of the FIG. 1 apparatus.
Figure 3:
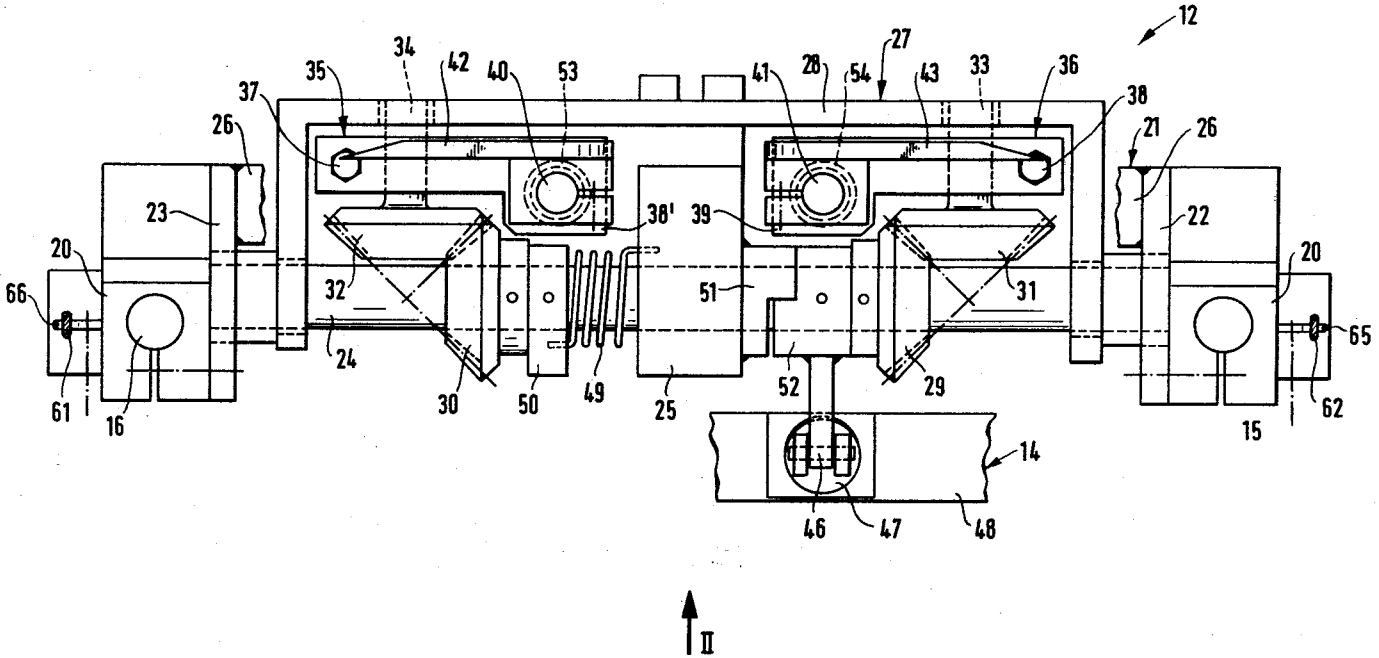
FIG. 3 is a section through the FIG. 1 apparatus taken on the line III—III.
Figure 4:
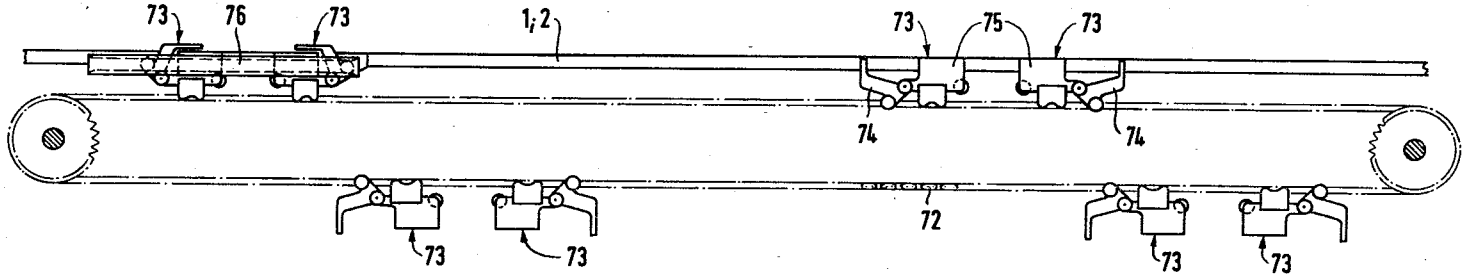
FIG. 4 is a side elevation of the grippers circulating on endless chains.

The arrangement and construction of the grippers is shown in more detail in FIGS. 2 and 3.

FIG. 2 illustrates the gripper and spreader unit 12 pivotable with the bracket 11. However, a corresponding gripper and spreader unit 13 is also provided in the apparatus frame in front of the lower margin of the opening of the tube section S.

The gripper and spreader unit 12 consists of a frame 14 of which the lateral guide rods 15, 16 are longitudinally displaceable in guide bushes 17, 18 which are secured to the support 19 of the bracket 11. The guide rods 15, 16 are interconnected at their front ends by a support 20 having a U-shaped central member 21. Between the limbs 22, 23 of the central member 21 the gripper shaft 24 is rotatably mounted and at the centre thereof the gripper 25 is freely rotatable, the web 26 of the central member 21 forming the counterjaw for the gripper. As best shown in FIG. 3, a U-shaped bracket 27 is mounted on the gripper shaft 24. Bevel gears 29, 30 are secured on the gripper shaft 24 at both sides of the gripper 25. These bevel gears engage with bevel gears 31, 32 of which the shafts 33, 34 are freely rotatable in the web 28 of the pivotable bracket 27. Slotted clamping members 35, 36 secured by clamping screws 37, 38 to the shafts 33, 34 of the bevel gears 31, 32 are in the form of levers and carry slideways 38', 39 for the pins 40, 41 at their free ends. At their front ends, the pins 40, 41 are connected to spreaders 42, 43 of which the outer edges 44, 45 include an angle of 90° in their spread condition of FIG. 2. In their retracted starting position, the edges 44, 45 of the spreaders 42, 43 are substantially parallel.

Secured to the gripper shaft 34 there is a lever 46 of which the free end is hinged to a hydraulic piston-cylinder unit 47 having its other end hinged to the support 48 of the frame 14.

The gripper 25 pivotable on the gripper shaft 24 is securely connected to one end of a torsion spring 49 of which the other end is fixed to the clamping member 50 connected to the gripper shaft 24.

After the pairs of suckers 6, 7 have slightly opened the margins of the openings of the tube section S, the grippers 25 are at first raised from the web 26 which forms the counterbearing for the gripper and which is disposed below the margin of the opening. If, now, the gripper shaft 24 is turned by the pneumatic piston-cylinder unit 27, the gripper 25 and the spreaders 42, 43 which are taken along by the bracket 27 which is swung along by way of the bevel gears are swung substantially into the plane of the wall of the tube section S that adjoins the slightly opened margin of the opening. Since the bracket 27 cannot swing further after the swinging in motion, the clamping force of the gripper 25 increases with further rotation of the gripper shaft 24 because the torsion spring 49 is increasingly turned. At the same time, the bevel gears 31, 32 are set into rotation so that the lever-like clamping members 35, 36 swing out and the spreaders 42, 43 are turned to their swung out position.

Claw-like coupling members 51, 52 secured to the gripper 25 and on the gripper shaft 24 have abutment faces which are superposed in the spread condition of the spreaders 42, 43.

The pins 40, 41 are surrounded by compression springs 53, 54 which are stretched between the slideways 38, 39 and heads 56, 57 placed on the ends of the pins.

A pneumatic piston-cylinder unit 58 secured to the rear transverse member 48 of the frame 14 has a piston rod carrying a transversely extending beam 55 of which the ends lie on the heads 56, 57 during projection of the piston rod and push the pins 40, 41 towards the table gap 3 against the force of the springs 53, 54.

Tension springs 59, 60 secured to the side limbs of the pivotable bracket 11 have their other ends connected to cables 61, 62 which pass over direction-changing rollers 63, 64 and are suspended from hooks 65, 66 secured to the frame 14. During pivoting of the pivotable bracket 11, the tension springs 59, 60 stress the frame 14 so that the base portion of the tube section S is pulled taut whilst it is being pulled open.

As soon as the base has been pulled open by pivoting the pivotable bracket 11, the beam 55 releases the pins 40, 41 so that the outer edges 44, 45 of the spreaders 42, 43 come to lie in the folded edges 67, 68 of the corner folds 69, 70 of the pulled-open base 71 with the force of the springs 53, 54.

After the base 71 has been opened fully, gripper tongs 73 running on endless chains 72 above the spreaders 42, 43 fall into place and fix the base folding and convey it to the next station in which, for example, an internal lock is applied.

The opened grippers 73 extend in or closely beneath the plane of the table plates 1, 2 so that they will not impede pulling open of the base. When the folding of the base has been completed, the upper jaws 74 of the gripper tongs engage over the folded edges 67, 68 of the pulled-open bases 71 and clamp same against the counter-jaws 75 of the gripper tongs. In the vicinity of the pulled-open bases 71, the gripper tongs 73 are guided in fixed guide rails 76. Control cams (not shown) are provided to open and close the gripper tongs 73.

We claim:

1. Apparatus for pulling open elongated flexible tube sections in the production of cross-bottom sacks to form base squares having folded edges and corner squares, said apparatus comprising:

a table plate with opposed sides and a central slot for guiding and holding said tube section, said tube section projecting beyond said central slot to provide a margin of sufficient length for forming said base squares;

suction means which initially pull open one end of said tube section and then hold said tube section in a pre-opened position;

first and second grippers centrally located between the opposed ends of said tube section, said first gripper being secured to said apparatus frame and said second gripper being secured to a pivotable structure, said pivotable structure being pivoted to said apparatus frame and being provided with a power means for swinging said pivotable structure through approximately 180° between the opposed sides of said table plate.

2. Apparatus according to claim 1, wherein first and second spreaders are located at both sides of said first and second grippers, respectively, in the frame and on the pivotable structure, each of said spreaders having outer edges which pull out the folded edges of the corner folds of said base square which when fully spread forms an angle of approximately 90°.

3. Apparatus according to claim 2, wherein each of said spreaders are pivotable to a contracted position about shafts normal to the plane expanded by said spreaders edges and about a gripper shaft parallel to said central gap in said table plate.

4. Apparatus according to claims 3, wherein said spreader shafts are mounted in a structure pivotable on said gripper shaft, a bevel gear being secured on each of said spreaders shafts and engaging a respective bevel gear on said gripper shaft, so that said gripper is freely rotatable on said gripper shaft, and is connected to said gripper shaft by a torsion spring, said gripper shaft being oscillatable by a lever, said lever having one end pivoted to a hinged pneumatic piston-cylinder unit.

5. Apparatus according to claim 4, wherein said torsion spring has one end secured to said gripper shaft by a clamping ring.

6. Apparatus according to claim 1, wherein an abutment on said gripper shaft co-operates with a counter-abutment on said gripper.

7. Apparatus according to claim 2, wherein said spreader is secured to pins which are longitudinally displaceable in spreader supports and are held in their limiting positions by compression springs.

8. Apparatus according to claim 7, wherein during pivoting of said pivotable structure, a pneumatic piston-cylinder unit pushes said pins toward said central slot in said table plate.

9. Apparatus according to claim 8, wherein said grippers and said spreaders and their respective drives are disposed in a frame, said frame being longitudinally displaceable in said apparatus frame and in said pivotable structure, said grippers and said spreaders are provided with pneumatic piston-cylinder units, respectively, for pulling the open base square taut.

10. Apparatus according to claim 9, wherein springs connected between said pivotable bracket and said frame are provided for pulling said frame taut.

11. Apparatus according to claim 10, wherein cables which pass over direction-changing rollers at both sides of said frame are held taut by said springs.

12. Apparatus according to claim 1, wherein gripper tongs secured to endless chains at both outer edges of said table plate clamp the pulled-open base squares in front of the ends of said spreader, so that the upper pivotable gripper tong jaws of said gripper tongs in the open position are disposed in or under the plane of said table plate, and that said gripper tongs transport the base square to the next processing station after said first and second spreaders and said first and second grippers have disengaged said base square.

13. Apparatus according to claim 12, wherein said gripper tongs are secured on rail guided carriages extending parallel to the longitudinal edges of said table plate.

14. Apparatus according to claim 1, wherein said table plate is inclined to the horizontal.

15. Apparatus according to claim 2, wherein at least two suction means are located on each side of said spreader.

16. Apparatus according to claim 15, wherein said pivotable structure suction means is movable to and fro by a pneumatic piston-cylinder unit.

17. Apparatus for pulling open elongated flexible tube sections in the production of cross-bottom sacks to form base squares having folded edges and corner folds, said apparatus comprising:

a table plate with opposed sides and a central slot for guiding and holding said tube section, said tube section projecting beyond said central slot to provide a margin of sufficient length for forming said base squares;

suction means which initially pull open one end of said tube section and then hold said tube section in a pre-opened position;

first and second grippers centrally located between the opposed ends of said tube section, said first gripper being secured to said apparatus frame and said second gripper being secured to a pivotable structure, said pivotable structure being pivoted to said apparatus frame and being provided with a power means for swinging said pivotable structure through approximately 180° between the opposed sides of said table plates; and first and second spreaders associated with said first and second grippers, respectively, each of said spreaders having outer edges which pull out the folded edges of the corner folds of said base square, each of said spreaders being pivotable to a contracted position about shafts normal to the plane expanded by edges of said spreaders and about a gripper shaft parallel to said central gap in said table plate.

* * * * *